United States Patent [19]

Stark

[11] 4,120,027

[45] Oct. 10, 1978

[54] COLLAPSIBLE LAMP SHADE HAVING INTERCHANGEABLE CONFIGURATIONS

[76] Inventor: Mortimer M. Stark, 245-42 62nd Ave., Douglaston, N.Y. 11362

[21] Appl. No.: 777,515

[22] Filed: Mar. 14, 1977

[51] Int. Cl.[2] ..... F21V 11/18; F21V 17/00

[52] U.S. Cl. ..... 362/352; 362/442

[58] Field of Search ..... 362/351, 352, 358, 442, 362/450, 355, , 356, 357, 433

[56] References Cited

U.S. PATENT DOCUMENTS

| | | | |
|---|---|---|---|
| 1,214,847 | 2/1917 | Tucker | 362/357 |
| 2,264,255 | 11/1941 | Burke | 362/356 |
| 2,516,286 | 7/1950 | Yeidel | 362/357 |
| 2,538,676 | 1/1951 | Enright | 362/352 |
| 2,819,386 | 1/1958 | Linderoth | 362/352 |
| 2,884,515 | 4/1959 | Fogel | 362/352 |
| 3,023,307 | 2/1962 | Okamoto | 362/352 |
| 3,787,676 | 1/1974 | Korach | 362/352 |
| 3,900,729 | 8/1975 | Smith et al. | 362/442 |

*Primary Examiner*—J. D. Mille
*Assistant Examiner*—Peter S. Wong
*Attorney, Agent, or Firm*—Martin G. Raskin

[57] ABSTRACT

A collapsible lamp shade which can be assembled quickly and easily in any desired one of a variety of interchangeable external configurations comprising an interchangeable shade member formed of one of various flexible fabric materials having upper and lower continuous collar portions, upper and lower interchangeable hoop members, each including an outer circumferentially extending sidewall around which one of the shade member collar portions is located, and a substantially horizontal shelf portion which maintains the location of each collar portion. A plurality of support rods extend between the opposed hoop members to stretch the shade member, while, conversely, the stretched shade member maintains the support rods in a fixed position within the hoop members. One of various contour ring members may be located over a sidewall of and against a shelf portion of one or both hoop members to give a desired interchangeable outer configuration to the shade member and an interchangeable inner liner may be provided.

Additionally, a separate spider assembly for supporting the lamp shade may be provided which is itself collapsible, and includes a substantially planar hub member to which a plurality of interchangeable leg members are removeably attached. Moveable bushings are provided on the free ends of the leg members whose positions may be selectively adjusted to properly align and position the lamp shade on a conventional harp and in proper relationship to the lamp itself.

17 Claims, 23 Drawing Figures

FIG. 1.
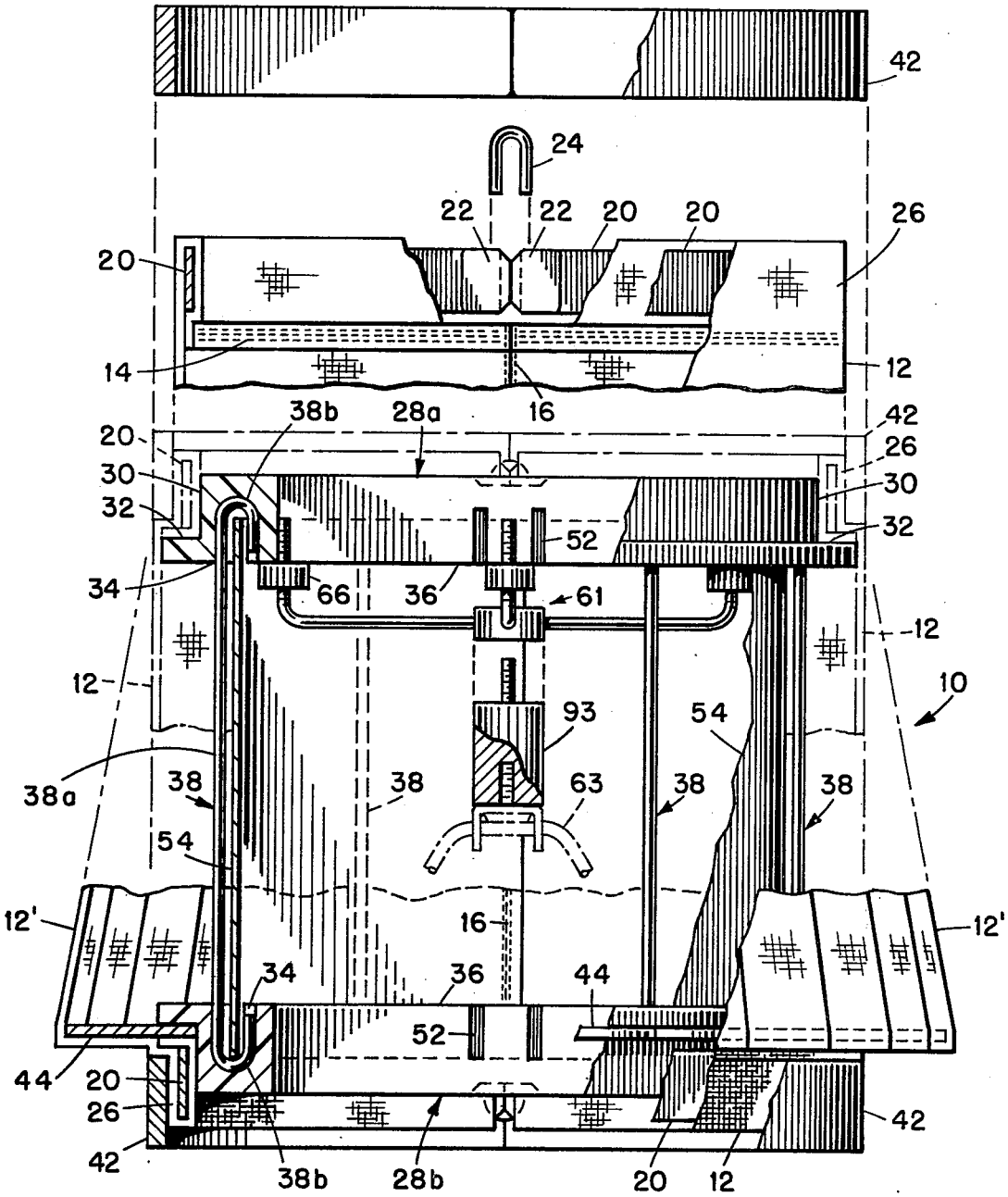
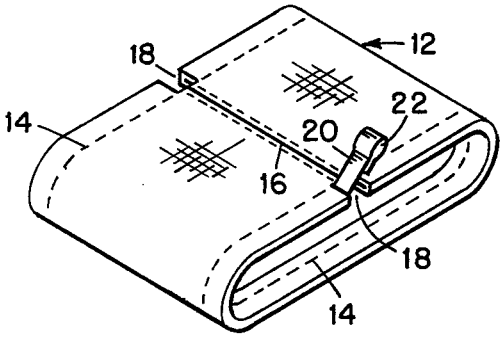
FIG. 2.
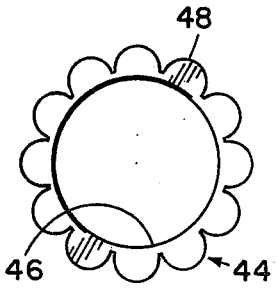
FIG. 3.
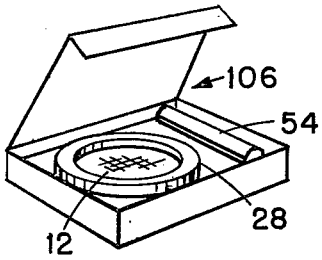
FIG. 4.

FIG. 8.
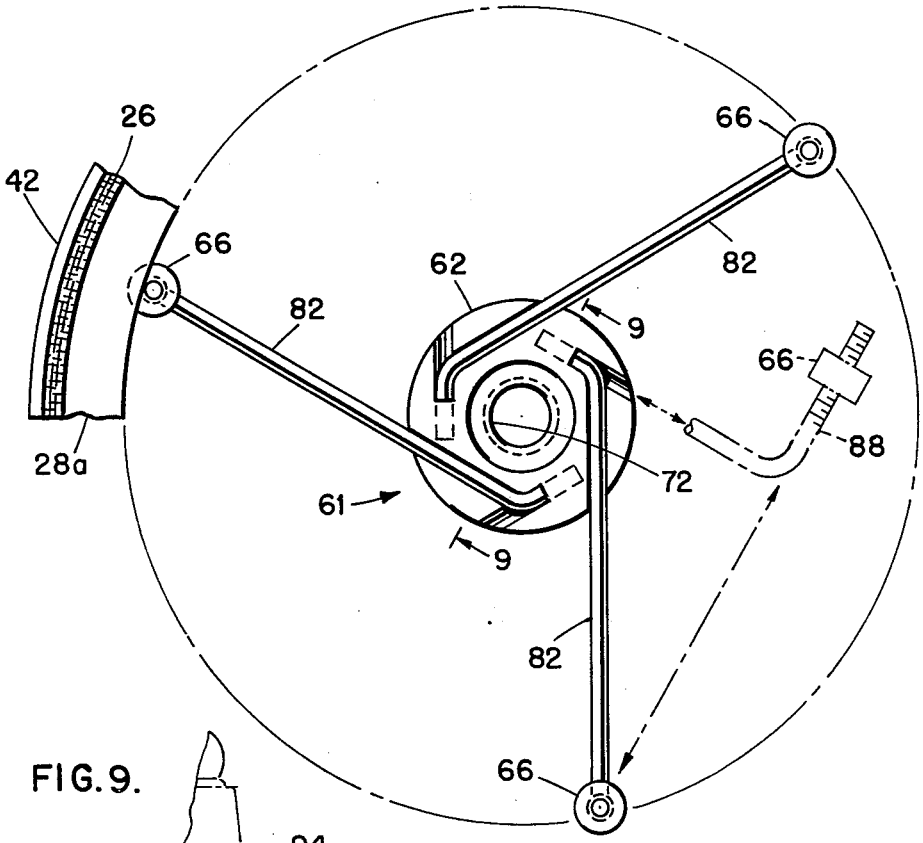
FIG. 9.
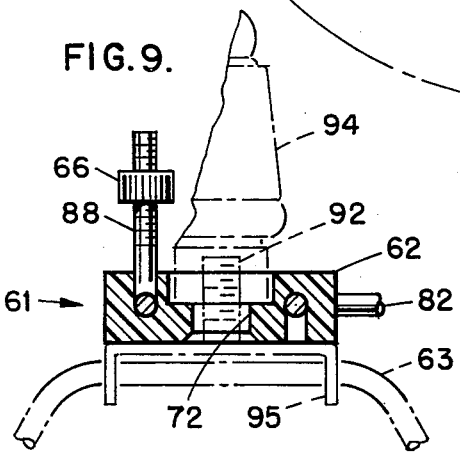
FIG. 11.
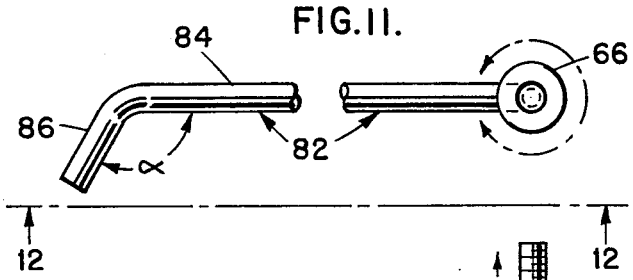
FIG. 10.
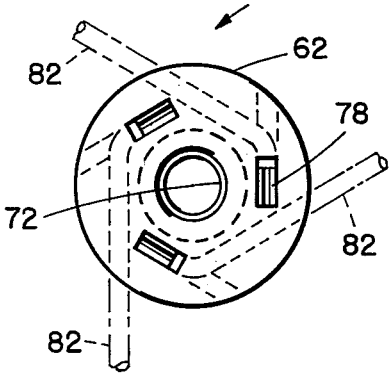
FIG. 12.
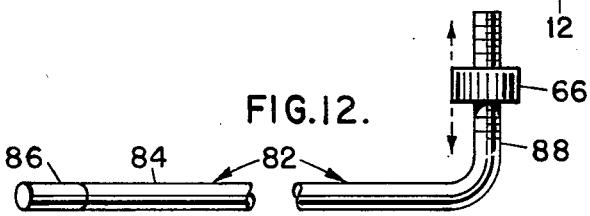
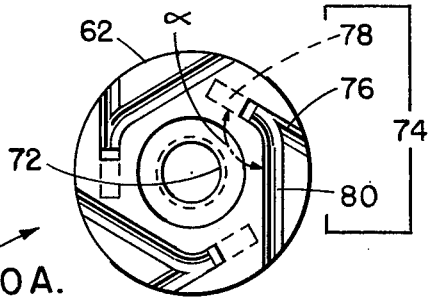
FIG. 10A.

FIG. 13.
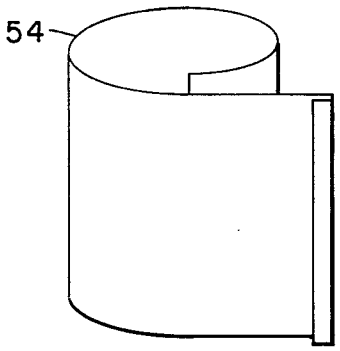
FIG. 14.
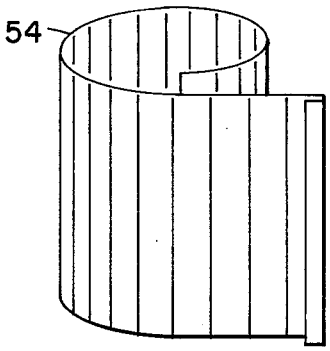
FIG. 15.
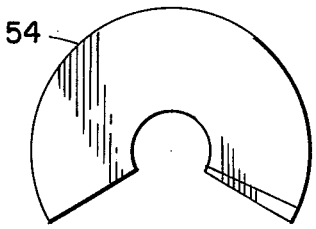
FIG. 16.
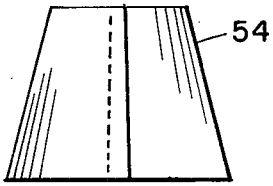
FIG. 17.
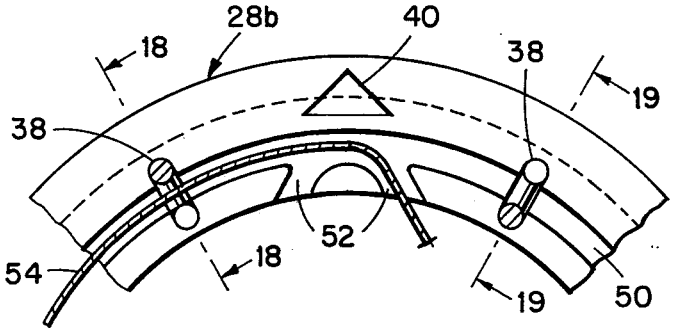
FIG. 18.
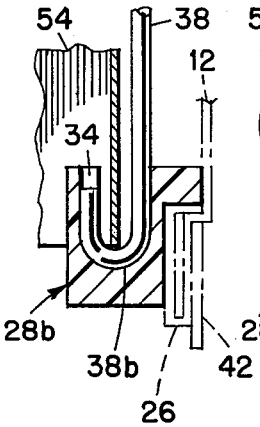
FIG. 19.
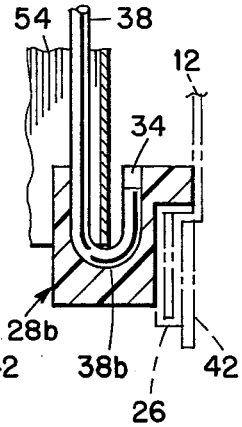
FIG. 20.
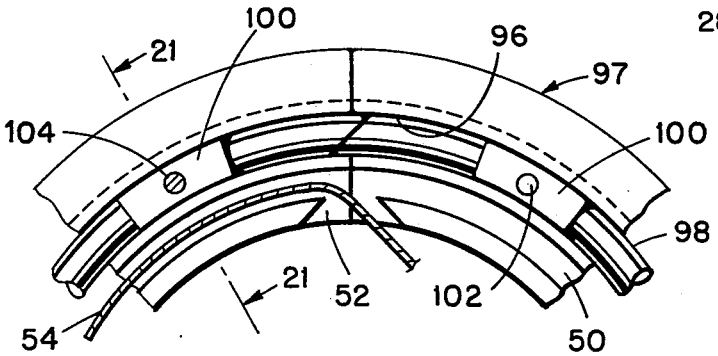
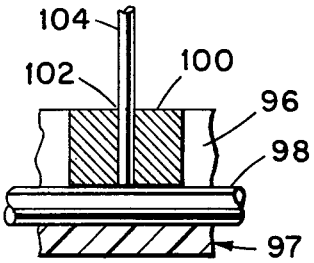
FIG. 22.
FIG. 21.
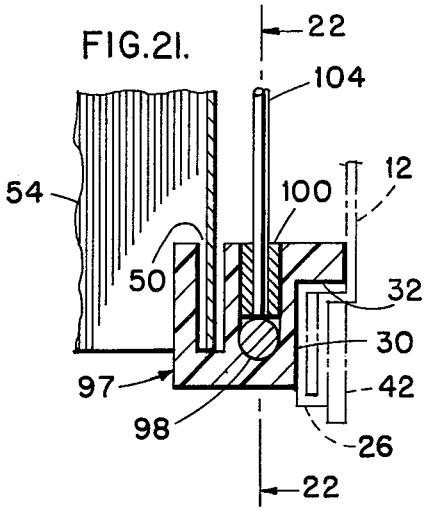

COLLAPSIBLE LAMP SHADE HAVING INTERCHANGEABLE CONFIGURATIONS

BACKGROUND OF THE INVENTION

This invention relates, generally, to improved lamp shades and, in particular, to lamp shades of the collapsible or knockdown type having interchangeable configurations and which are adjustable and collapsible for economical manufacturing, shipping and storage, and which can be easily assembled or disassembled for any reason by persons with minimum skills without tools, fixtures or any previous experience in the art of lamp shade assembly.

The majority of lamp shades currently available are pre-assembled in a factory or by persons experienced in the art. Such pre-assembled lamp shades pose serious shipping and storage problems due to their configurations and usually substantial volume. Such problems still exist even when these lamp shades are formed in particular configurations so that they may be nested within each other for more economical shipment or storage.

Accordingly, it has been suggested to manufacture lamp shades in a collapsed or knock-down form for subsequent simple assembly either by the retailer or by the ultimate consumer. However, while solving some of the shipping and storage problems mentioned hereinabove, such collapsible lamp shades have not been found to be entirely satisfactory.

For example, once assembled, most collapsible lamp shades cannot be easily disassembled and re-assembled for purposes of washing or cleaning, nor do they provide the means for substituting interchangeable components to provide various external configurations when desired.

Additionally, with respect to currently-proposed collapsible lamp shades and especially referring to collapsible lamp shades wherein the outer shade coverings comprise flexible fabric materials, inner linings are generally not provided to assist in diffusion of the undesirable harsh light emanating from the bulb and through the fabric when the bulb is lighted.

Presently available lamp shades of the fabric covered type are unsatisfactory for additional reasons. Such lamp shades are generally pre-assembled in a factory or by persons particularly skilled and equipped in the art of making fabric covered lamp shades. Such pre-assembled lamp shades are usually made by first producing a substantially permanent welded wire form of a specific size and configuration. Such forms usually include an upper hoop to which a support spider is permanently welded, and support rods which are permanently welded to both the upper hoop and a lower hoop member. To this permanent structural wire form, a flexible fabric covering, with or without a fabric lining, is then applied by sewing or gluing. These conventional procedures usually require special tools, fixtures, and special skills. Different assembly fixtures are necessary to accommodate the different shade sizes and configurations. Additionally, the wire forms and the finished lamp shade are highly susceptible to damage or distortion in shipment and handling. Furthermore, the volume of such structures adds considerably to the packing and shipping costs and usually require special careful handling and considerable storage space, all of which evidently increase the cost of such shades to the consumer.

Furthermore, not only is the outer configuration in factory pre-assembled shades determined upon assembly but the colors and decorative trim associated with such shades are also usually permanently determined and cannot be varied easily by the consumer if so desired to accommodate a change in room decor, a desired mood, or for any other reason.

SUMMARY OF THE INVENTION

Accordingly, one object of the present invention is to provide a new and improved collapsible or knock-down type lamp shade.

Another object of the present invention is to provide a new and improved collapsible lamp shade having improved esthetic qualities.

Still another object of the present invention is to provide a new and improved collapsible lamp shade whose outer configuration may be interchangeably varied as desired at the factory, by the retailer, or by the consumer by substituting alternate, interchangeable components in various different combinations.

A further object of the present invention is to provide a new and improved collapsible lamp shade whose colors may be varied as desired by the ultimate consumer and to which alternate decorative trim may be easily added, changed, or removed therefrom as desired.

A still further object of the present invention is to provide a new and improved collapsible lamp shade whose assembly does not require any unusual degree of skill.

A still further object of the present invention is to provide a new and improved collapsible lamp shade which can be easily disassembled subsequent to assembly for washing, cleaning, recovering, restyling, storage, or shipping.

A still further object of the present invention is to provide a new and improved collapsible lamp shade of the type having an outer shade covering formed of a flexible fabric which also includes an interchangeable inner lining to assist in diffusion of the light emanating from the lamp bulb, conceal interior structural elements when desired, provide a reflective surface inside the lamp shade, and be plain or decorative in design or colors.

A still further object of the present invention is to provide a new and improved collapsible lamp shade with interchangeable parts of various sizes, shapes, configurations, etc., which can be used in various combinations to provide for the simple assembly of the shade of any one of a variety of sizes, configurations, styles and colors.

A still further object of the present invention is to provide a new and improved collapsible lamp shade which can be easily assembled into a firm, sturdy, symmetrical configuration without having a pre-constructed welded structural frame and which eliminates the need for special skills to sew and apply the outer fabric cover to the pre-constructed welded frame.

A still further object of the present invention is to provide a new and improved collapsible lamp shade whose components can be packaged in a relatively flat container for economical shipping, storage or mailing at comparatively lower cost than pre-constructed conventional lamp shades.

A still further object of the present invention is to provide a new and improved collapsible lamp shade which can be easily assembled and decorated in a particular configuration by the retailer or the ultimate consumer and whose configuration can be easily changed subsequently at any time in an economical fashion.

A still further object of the present invention is to provide a new and improved collapsible lamp shade which may be reversed (top to bottom) on the lamp to provide an entirely different visual appearance.

Yet another object of the present invention is to provide a new and improved spider member which is collapsible and which has interchangeable components to accommodate various size lamp shades.

Briefly, in accordance with one embodiment of this invention, these and other objects are attained by providing a shade member formed of a flexible fabric material whose upper and lower edges are hemmed to provide continuous collar portions. A pair of hoop members, each including an outer circumferentially extending sidewall and a substantially horizontal shelf extending outwardly from the sidewall, are located in parallel, spaced, opposed relationship, with each respective collar portion of the shade member being located around a respective hoop member sidewall and against a respective shelf. A plurality of equally spaced support rods extend between the opposed hoop members inwardly of the shade member which maintain the shade member in a stretched, symmetrical configuration.

A ring member having a contoured outer periphery may be located over a sidewall of one (or both) of the hoop members to bear against the respective shelf so that it is disposed between the shade member collar portion and the shelf portion. Upon the shade member being stretched between the hoop members, the contour ring provides a similarly contoured shape to the shade member.

The hoop members may further be provided with continuous channels inwardly of the sidewall to receive opposed side edges of a shade liner which facilitates diffusion of the light emanating from the bulb, conceals the support rods if desired, and provides a reflecting surface inside the lamp shade.

A separate, collapsible spider assembly may be employed with the collapsible lamp shade of the present invention and includes a substantially planar hub member having channels provided thereon for removably attaching one end portion of each of a plurality of leg members thereto. The free end of each leg member has a bushing threadedly engaged therewith whose position thereon may be selectively adjusted to align the lamp shade relative to the lamp when required.

By virtue of the above-described structure, a lamp shade is provided which may be collapsed for purposes of economical shipment, mailing or storage and whose assembly requires no tools and no unusual skill. The interchangeable liner provides an esthetically pleasing diffusion of light not usually available with collapsible lamp shades of like nature. Further, by provision of optional and various contour ring members, the outer configuration of the lamp shade may be varied as desired by the ultimate user. The nature of the structure allows for various optional decorative trim accessories to be associated with the lamp shade as desired by the ultimate user, which can easily be changed in moments for any reason.

DESCRIPTION OF THE DRAWINGS

A more complete appreciation of the invention and many of the attendant advantages thereof will be readily appreciated as the same becomes better understood by reference to the following detailed description when considered in connection with the accompanying drawings wherein:

FIG. 1 is a side view in partial section of the collapsible lamp shade of the present invention with portions shown in exploded relationship;

FIG. 2 is a perspective view of the shade member of the present invention;

FIG. 3 is a plan view of an example of one form of contour ring member according to the present invention;

FIG. 4 is a perspective view of typical packaging for the lamp shade of the present invention in its collapsed form;

FIG. 8 is a plan view of the collapsible spider assembly of the present invention illustrating its use with the collapsible lamp shade of the present invention;

FIG. 9 is a side view in section of the collapsible spider assembly showing its use in conjunction with the harp apparatus of the lamp;

FIG. 10 is a bottom view of the hub member of the spider assembly of the present invention;

FIG. 10A is a top view of the hub member of the spider assembly of the present invention;

FIG. 11 is a plan view of a leg member of the collapsible spider assembly of the present invention;

FIG. 12 is a side view of a leg member of the collapsible spider assembly of the present invention;

FIG. 13 is a perspective view of a liner for use with a lamp shade having identical hoop members at the top and bottom of the shade, including frusto-conical configurations formed when a contour ring is added to the shade assembly;

FIG. 14 is another embodiment of a liner for use with same lamp shades as described in FIG. 13;

FIG. 15 is a plan view of a liner to be used with a collapsible lamp shade of the present invention having a frusto-conical configuration when the upper hoop member is a different size than the lower hoop member;

FIG. 16 is a side view of the liner of FIG. 15 in assembled form;

FIG. 17 is a plan view in section of a portion of the lower hoop member of the collapsible lamp shade according to the present invention;

FIG. 18 is a section view taken along 18—18 of FIG. 17;

FIG. 19 is a section view taken along line 19—19 of FIG. 17;

FIG. 20 is a plan view of a portion of another embodiment of the collapsible lamp shade according to the present invention;

FIG. 21 is a section view taken along 21—21 of FIG. 20; and

FIG. 22 is a section view taken along 22—22 of FIG. 21.

DESCRIPTION OF THE PREFERRED EMBODIMENT

Figure 5:
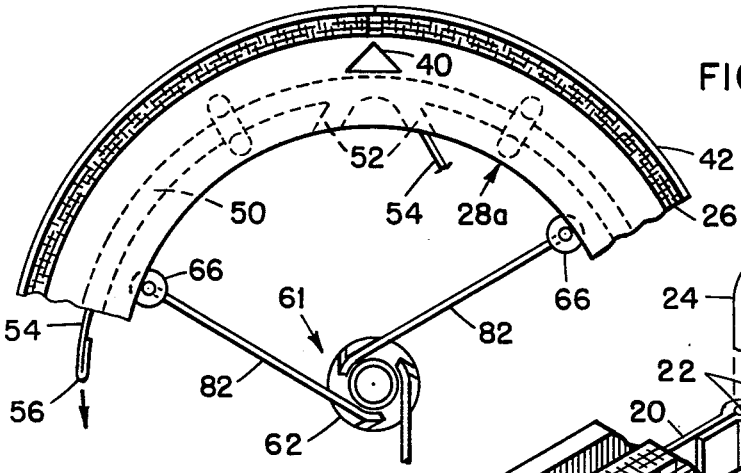
FIG. 5 is a plan view of a portion of the lamp shade according to the present invention illustrating its use with the collapsible spider member.

Referring to the drawings wherein like reference characters designate identical or corresponding parts throughout the several views, FIG. 1 illustrates in assembled form the collapsible lamp shade, generally denoted as 10, of the present invention. The lamp shade 10 comprises a shade member 12 (FIG. 2) preferably formed of a flexible, fabric material. It has been found that stretch-knit fabrics are particularly suited for use in the present invention, and various styles, materials, colors, textures and patterns may be chosen as desired. Referring to FIG. 1 in conjunction with FIG. 2, the upper and lower edges of shade member 12 are turned down and hemmed as at 14, and the side edges then joined by conventional means, such as by stitching as at 16 (FIG. 2). Opened portions 18 are provided in hems 14 at the upper and lower ends of the vertically extending seam 16 to permit the insertion of a relatively rigid but flexible strip 20 through each of the respective beams 14. Strips 20 may be formed of any suitable material, such as wire, metal or plastic. After locating each strip 20 in its respective hem 14, looped ends 22 of each strip 20 are fastened together so that each strip 20 forms a continuous band within each hem 14. Such fastening may be accomplished by inserting a U-shaped pin 24 (FIG. 1) through the adjacent loops 22 in each strip 20.

Thus, the shade member 12 has a pair of collar portions, generally denoted as 26, at its upper and lower edges defined by the hems 14 and the strips 20 passing therethrough.

Figure 6:
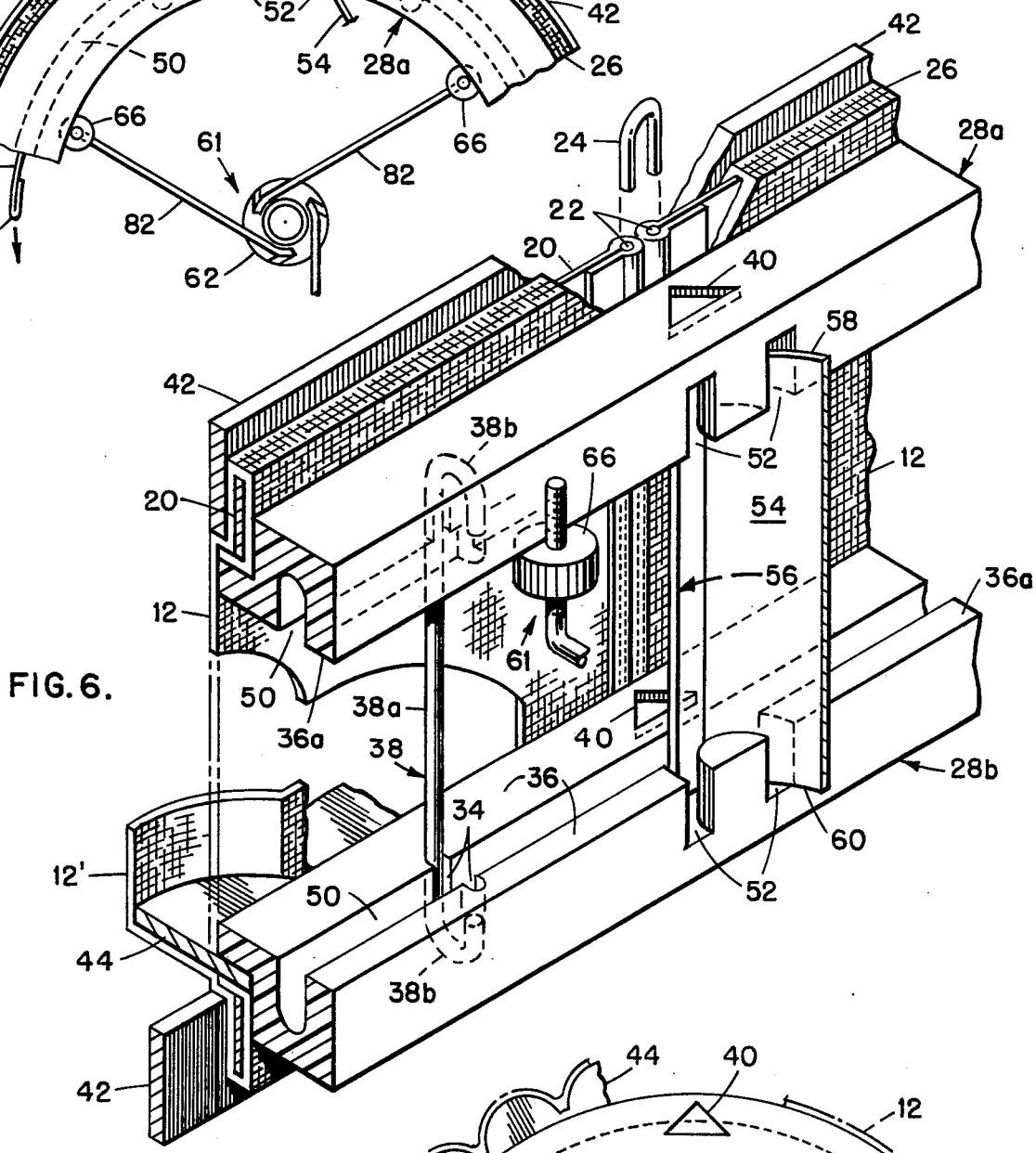
FIG. 6 is a perspective view of a portion of the interior of the collapsible lamp shade of the present invention.

Referring to FIG. 1 in conjunction with FIG. 6, upper and lower hoop members **28*a*, 28*b*, respectively, are provided which in the present embodiment are preferably identical in configuration. Each hoop member 28 is at least partially defined by an outer sidewall 30 extending around the hoop member and a substantially horizontal shelf portion 32 extending outwardly from each sidewall 30. The length of each shade member collar portion 26 is just slightly greater than the length of each outer sidewall 30 so that collar portions 26 can be located around sidewalls 30 as shown in FIG. 1. As will be more fully described hereinbelow in the description of the construction of the lamp shade of the present invention, the shelf portions 32 maintain the collar portions 26** in place in the assembled structure.

Figure 7:
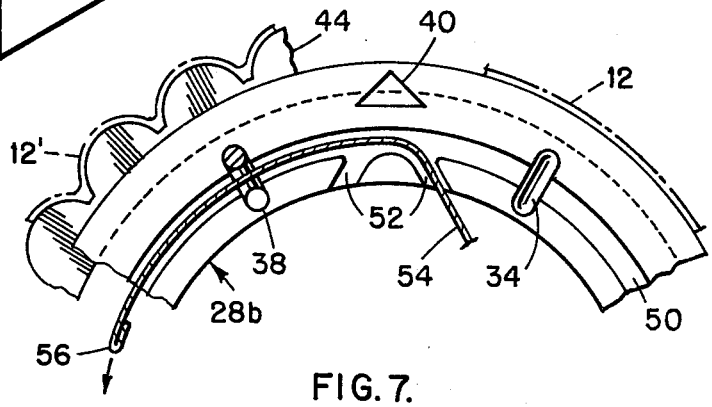
FIG. 7 is a plan view of the lower hoop member and associated structure of the present invention.

Referring to FIGS. 1, 6 and 7, a plurality of slots 34 are provided within edge surface 36 of each hoop member 28, which slots receive the end portions of a corresponding plurality of support rods 38. Each support rod 38 in the present embodiment includes a straight body portion **38*a* and a pair of U-shaped portions 38*b*, which end portions are received within slots 34. Support rods 38 function to locate the hoop members 28 in mutually spaced, parallel, opposed relationship to thereby maintain the shade member 12 in a constant stretched configuration as will become clearer hereinbelow. Since knitted fabric when stretched tends to return or snap back to its original size, the shade member, which is in a constant stretched configuration, exerts a compressive force on support rods 38 and maintains the support rods 38 firmly in slots 34 of both hoop members 28. It has been found that between six and eight such support rods 38 with corresponding sets of slots 34 being formed in the respective hoop members 28 to receive their end portions 38*b***, are usually desireable.

Indicia 40 (FIG. 6) are provided on both the top and bottom edge surfaces of each hoop members 28 at identical positions on the respective hoop members 28 to assist in aligning the same during assembly of the lamp shade as described hereinbelow.

In the assembly of the lamp shade of the present invention, one looped end 22 of each of the flexible strips 20 is inserted into one open end portion 18 of each of the hems 14 of shade member 12 and is drawn through the entire length of the hem 14 until both looped ends 22 of strip 20 are exposed at open end portion 18. The adjoining looped ends 22 are locked together by inserting the pin 24 into both looped ends 22 of each strip 20. As mentioned hereinabove, the strips 20 and, preferably, associated hems 14 are adapted to fit snugly around the sidewalls 30 of hoop members 28, allowing for fabric thickness. It is to be understood that only the strip 20 must be of a length adapted to snugly fit around sidewall 30 of hoop member 28 since the length of hem 14 may be longer than strip 20 and then bunched up or gathered together, thereby giving a shirred or pleated effect to the shade member 12.

The upper hoop member **28*a* is then located through upper collar portion 26 and the collar portion then urged downwardly around sidewall 30 until it abuts the shelf portion 32. During this procedure, the vertical stitching 16 of shade member 12 is aligned with indicia 40 of upper hoop 28*a*. The same procedure is followed with respect to positioning the lower collar portion 26 of shade member 12 around the sidewall 30 of lower hoop member 28*b*, again aligning the vertical stitching 16 with indicia 40 provided on lower hoop member 28*b*. Slots 34 are equally spaced in an identical manner in top and bottom hoop members 28 so that upon aligning indicia 40 with the vertical stitching 16 on shade member 12**, the slots in both the upper and lower hoop members will be in direct vertical alignment with each other.

The end portions **38*b* of support rods 38 are then inserted into slots 34 of upper and lower hoop members 28*a*, 28*b*. In this connection, it is understood that upper and lower hoop members 28*a*, 28*b* will have to be urged away from each other against the yielding constraint of fabric shade member 12 to a position further apart than is finally the case. For this reason, it is preferred to use a stretch-knit fabric as the material from which shade member 12 is formed. However, it is understood that the present invention is not limited to such materials but may be practiced by using an appropriate fabric which has a modicum of stretch capability. The height of support rods 38 is directly related to the height of shade member 12 in a manner such that upon being positioned within slots 34, the rods will stretch the shade member 12 between the hoop members 28, and the support rods 38 will be maintained in a substantially fixed and symmetrically aligned position within slots 34 by the compressive forces exerted by stretched shade member 12** on them.

It should also be understood that the present invention is not limited to support rods 38 having the particular configuration described hereinabove. For example, the support rods 38 may be entirely straight or linear with slots 34 being replaced by holes or bores to receive the end portions of the straight rods. Other configurations for support rods are also possible within the scope of the present invention. For example, the support rods 38 may be formed to outwardly extend beyond the outer periphery of one or both hoop members 28, with or instead of one or more various outwardly extending contour ring members 44, described hereinbelow, thereby providing various outwardly extending configurations to the stretched shade member 12.

Additionally, optional, interchangeable decorative band members 42 may be provided over and around shade member collar portions 26 to obscure the same when desired, thereby further enhancing the esthetic characteristics of the lamp shade.

As presently described, the lamp shade will have a cylindrical outer configuration, the shade member 12 being shown in phantom in FIGS. 1 and 6. It is an object of the present invention to provide the capability of changing the outer configuration of the lamp shade as desired. To this end, a contour ring member 44 may be positioned over the top or bottom (or both) hoop member 28 prior to locating the hoop member 28 within shade member 12 as described above. Contour ring member 44 (FIG. 3) has a central opening 46 which corresponds in diameter to that of hoop member sidewalls 30 so that it may be located over the sidewalls 30 and against the associated shelf portion 32. For example, as seen in FIGS. 1 and 6, the contour ring member 44 is provided over the lower hoop member **28*b*. The outer periphery 48 of ring member 44 is suitably contoured (such as being scalloped as shown in FIG. 3), so that upon locating the combination hoop member 28*b* and associated ring member 44 within shade member 12 and thereafter fitting the lower collar portion 26 around sidewall 30 as described above, the shade member, now designated 12, will be drawn along the underside of ring member 44 and around the contoured outer periphery 48 thereof, thereby giving the shade member 12 a similarly contoured configuration. Since the outer periphery of the ring member 44 is of a larger diameter than the shelf portion 32 of the upper hoop member 28*a*, the shade member will obtain a frusto-conical configuration as indicated in phantom at 12' in FIG. 1. Although the contour ring member 44 is shown in the present embodiment as being positioned about the lower hoop member 28*b* and has a scalloped outer periphery, it is understood that such ring members 44 may be positioned on the lower, upper or both of the hoop members 28** and may have an outer periphery contoured in something other than the scalloped design. Thus, it is seen that the number of possible outer configurations of the lamp shade according to the present invention is virtually unlimited.

Similar outer configurations of the lamp shade may be obtained by other means. For example support rods 38 may be formed with body portion **38*a* extending outwardly beyond the periphery of hoop members 28 so that the shade member will be contacted by them. Additionally, hoop members 28** may be formed having different diameters instead of being identical as shown in the drawings.

Turning to FIGS. 6 and 7, each hoop member 28 preferably has a continuous channel 50 formed within edge surface 36 thereof which extends circumferentially around the hoop member. Thus, as seen in FIG. 6, the channels 50 formed within the upper and lower hoop members **28*a*, 28*b* are in vertical alignment with each other after assembly. Entrance openings 52 into channels 50 are formed through the inner wall of the respective hoop members. In the present embodiment, it is seen that the end portions 38*b* of support rods 38 fit within channels 50** and, accordingly, do not obstruct the same.

After assembling the lamp shade in the manner described hereinabove, an inner liner 54 is provided by inserting the leading edge 56 thereof through openings 52 so that the upper and lower liner edges 58, 60 are received within channels 50. The liner 54 is then drawn completely around the circumference of the hoop members **28*a*, 28*b* through channels 50. In the embodiment shown in FIG. 6, the support rods 38 would thus be located between the shade member 12 and the inner liner 54. The liner may be a sheet of opaque or translucent parchment, fibreglas, or plastic material such as commonly used in the manufacture of hardback or vinyl lamp shades. The liner preferably has a height somewhat less than the support rods 38 so that it may be freely moved within channels 50, and a length sufficient to provide a slight overlap of its terminal edges for completely shielding and diffusing the light emanating from the lighted bulb. It can be seen that the liner 54 can be easily removed for cleaning or replacement by merely withdrawing it from the channels through openings 52. The liner can be provided in plain form as seen in FIG. 13 or can be textured or patterned as shown in FIG. 14. Additionally, the liner may be a unitary sheet packaged in compact, rolled-up form or formed in flat sections for compact packaging, and may be in various colors or designs. Further, referring to FIGS. 17 through 19, it is seen that the support rods 38 may be either located between the liner and the shade member as described above or may be reversed within slots 34 so as to be located inwardly of liner 54 to further diffuse the undesirable shadows of the support rods emanating through the shade member 12 when the bulb is lighted. In any event, various liners having an appropriate color or design pattern may be easily substituted for each other by merely withdrawing the existing liner from channels 50 and inserting the new liner therein. Liners described hereinabove may be provided to fit the relatively flat packaging 106, as shown in FIG. 4**.

Referring to FIGS. 1 and 5, in installing the lamp shade 10 of the present invention upon a lamp, a separate spider assembly 61 is affixed to a harp 63 which is commonly a part of the lamp itself. Although the spider assembly 61 shown in FIGS. 1 and 5 is of a collapsible form especially suited to the present invention, the lamp shade 10 may be supported by any conventional spider which usually includes a plurality of leg members permanently affixed to and extending outwardly from a central hub, which may be modified to include the adjustable features of the spider assembly 61 shown. As shown in FIGS. 1, 5 and 8 through 12, spider leg members 82 extend substantially radially outwardly from a hub 62 and have upwardly turned free end portions 88 having free moving bushings 66 threadedly engaged thereto. As shown in FIG. 6, the bushings 66 bear against and under the inner portion **36*a* of surface 36 of hoop member 28*a*. By selectively rotating bushings 66, the position of shade 10 may be selectively adjusted and horizontally aligned to compensate for any undesireable tilt of the lamp shade due mainly to possible distortion in the harp 63** which is commonly a part of the lamp itself.

Additionally, it should be understood, that a spider assembly may not be required in some instances. For example, some lamps are commonly provided with a globe, usually translucent, which is provided over the bulb of the lamp and which in some instances are open and flared outwardly from the center of the lamp. The lamp shade of the present invention may therefore be modified whereby the top edge surface of the globe itself provides the support function for the lamp shade 10, thereby eliminating the requirement for a support spider. In such instances, and because the translucent globe itself provides the diffusion of the bulb, an inner liner member may not be required except for additional decorative purposes. The lamp shade of the present invention may also be additionally modified to adapt to and be supported by many other varieties of lamps as are commonly manufactured, such as wall lamps, floor lamps, ceiling lamp fixtures, etc.

Referring to FIGS. 8 through 12, a particular spider assembly especially suited for use with the lamp shade of the present invention is illustrated. Referring to these figures, a spider assembly 61 is illustrated which is conveniently collapsible and may be provided with sets of legs each having lengths different from the legs of another set and which are interchangeable to accommodate lamp shades of different sizes. No tools or welding is required for assembly or disassembly of spider assembly 61. Spider assembly 61 includes a central hub member 62 having a central opening 72 adapted to receive the upwardly extending bolt commonly provided with the harp of a lamp. Hub member 62 is substantially planar and has a sufficient plurality of sets of channels 74 formed in its upper surface. Referring to FIG. 10A, each channel set 74 includes a first channel 76 extending from the periphery of hub member 62 terminating in an enclosed passage 78. Additionally, each channel set 74 includes a second channel 80 (FIG. 10A) also extending from the periphery of hub member 62 and intersecting first channel 76 at an obtuse angle $\alpha$ (see FIG. 10A).

Associated with each channel set 74 is a leg member 82 comprising a rigid rod having a body portion 84, an integral end portion 86 extending at substantially the same obtuse angle $\alpha$ to the body portion 82 as described previously with respect to channel sets 74 and another free end portion 88 (FIG. 12) integral with the body portion which extends substantially perpendicularly to the plane defined by the body 84 and other end portion 86. As seen in FIG. 8, each leg member 82 is removeably attached to hub member 62 by inserting end portion 86 into first channel 76 until it is received within enclosed passage 78 whereupon the leg member 82 is rotated along an axis defined by the axis of leg member end portion 86 until the initial portion of the length of body portion 84 is received within second channel 80. This will result in leg member end portion 88 extending substantially perpendicularly upwards. Bushing 66 is threadedly engaged on leg member end portion 88 so that upon rotation its position may be selectively adjusted thereon to adjust the orientation of the lamp shade as previously described. As shown in FIG. 9, the upwardly extending bolt 92 of harp 63 extends through the central opening 72 of hub member 62 and is fastened thereon by a conventional finial 94. The adjustable spider assembly 61 thereupon becomes a part of, and is fixed to the lamp itself and need not be removed from harp 63. Since the lamp shade assembly 10 is not attached to spider assembly 61 and is only supported by the spider assembly by means of the placement of the inner portion of edge surface 36 of upper loop member **28*a* of the lamp shade assembly 10 the rest upon and be supported by all of the bushings 66 of the spider assembly as shown in FIG. 6, the lamp shade assembly 10 is free to be turned or be removed at any time without having to turn or remove the spider assembly 61 from harp 63. When both upper and lower hoop members are identical and a contour ring is included in the assembly, thereby providing a different shade contour at the top or bottom, the lamp shade may then be rested upon and be supported by the spider assembly in either of two ways. The top of the shade may become the bottom of the shade by simply removing the shade from the separate spider assembly and then reversed and replaced upon the spider assembly thereby producing an entirely different visual effect without any structural changes to the lamp shade. The desired positioning of the lamp shade assembly 10 is such that the vertical seam 16** is preferably positioned to the rear of the shade in relationship to the lamp itself. In this position, no seans will be visible except at the rear of the lamp.

Referring to FIG. 9, the harp platform 95 (shown in phantom), to which the hub 62 is attached with finial 94, can only be moved in limited directions in order to position or align a conventional lamp shade in relationship to the lamp itself. Further adjustments of the lamp shade to cause it to hang in a straight manner usually requires bending of the wire components of the spider until a satisfactory position for the shade is attained. Once attained, the conventional shade will hang properly only in that position, and if for any reason the original conventional shade is changed in relationship to the conventional harp, the same time consuming method of straightening the shade must be repeated. The means provided in the present invention simplifies the method used for such adjustments and allows for additional selective adjustment around the entire inner periphery of the lamp shade assembly of the present invention in moments, without having to bend any wire components of the spider.

As shown in FIG. 1, should the harp 63 of the lamp itself be of an undesireable height, and a larger harp is not available, an extension 93 comprising a cylindrical member having a threaded bore to which the harp bolt may be threaded, and an upwardly extending bolt at its upper end may be employed to attain the additional height desired for the existing harp 63.

It is understood that many variations and modifications may be made to the present invention as presently described within the scope of the present invention. For example, the hoop members may not necessarily be of identical configuration but may, for example, have different diameters. It is believed that it would be clear to one having skill in the art that minor modifications would be made to the associated structure in such a case. For example, the support rods 38 and the associated slots in which their end portions are disposed may have to be slightly modified. Further, the channels 50 may have to be slightly canted in such a case and, when employed, the liner 54 would have to be modified, such as is shown in FIGS. 15 and 16.

In the embodiments of the invention described hereinabove, hoop members 28 were preformed with a circular configuration, such, for example, as by a molding process. However, the hoop members may be formed in configurations other than circular. It is also within the scope of the present invention to preform hoop members of various configurations by a metal stamping and forming process. It is also within the scope of the present invention to manufacture the hoop members by extrusion and welding of elements which may be subsequently formed into various hoop configurations.

For example, referring to FIGS. 20 through 22, a hoop member 97 is shown which is formed by locating an elongate rigid member 98, such, for example, as a relatively heavy stock metallic wire, which is preformed into a desired configuration, such as circular (as shown), and welded together where the respective ends abut, into a channel 96 formed in an extruded length of semi-rigid flexible material, such, for example, as plastic, having a channel 50 formed inwardly of channel 96 and an opening 52 providing access into channel 50.

The extrusion also includes a sidewall 30 and a shelf 32 corresponding to the sidewall and shelf provided on hoop member 28. A sufficient length of the extrusion is cut to fit and be disposed over rigid wire member 98 within channel 96 thereby providing a hoop with structural integrity in the configuration of rigid member 98. Thus, straight extruded sections may be cut to proper length for any desired lamp shade configuration, thereby eliminating the need for individual molds for each different size and shape hoop member. In this case, the same extrusion die may be used for any desired hoop member configuration.

A plurality of molded plugs 100, each having a vertically extending bore 102 formed therethrough, are disposed with appropriate spacing over wire member 98 within channel 96 of each hoop member 97 to provide means for receiving the ends of support rods 104 which in this case comprise straight rod members. Thus, the plugs are appropriately spaced within and around each hoop member while rigid member 98 provides the structural support and restricts any movement of the plugs after installation.

The assembly of the lamp shade using the hoop members 97 illustrated in FIGS. 20 through 22 is essentially the same as described hereinabove.

Referring to FIG. 4, it is easily seen that the collapsible lamp shade of the present invention may be easily packaged within a box 106, in a relatively compact form, for economical shipment, mail order marketing, retail marketing and requires considerably less floor, counter, or warehousing space due to its reduced volume.

In addition to the decorative band members 42 which may be optionally provided over the collar portions of shade members 12, other decorative trim may be added if desired. For example, interchangeable decorative or colored strips or panels may be provided vertically over the outer surface of shade member 12 by tucking their end portions between band member 42 and collar portions 26 at the top and bottom of lamp shade 10. In addition, individual interchangeable decorative or colored panels may be inserted into channel 50 in addition to the liner 54 which may be moved in various degrees to provide various striped or decorative patterns to provide interesting and variable effects emanating through shade member 12 when the lamp is lighted.

As mentioned above, although contour ring member 44 is shown on the bottom hoop member **28*b*, such provision is optional and, additionally, such rings can be installed on either or both of the top and bottom hoop members 28** for various desired effects and lamp shade configurations. The contour ring members may be formed with vertically extending scallops or inclined scallops and may be installed either inside or outside of the lamp shade for shadow or external effects and styling.

Thus, it may be seen that a collapsible lamp shade has been provided which has unique esthetic qualities and whose outer configuration may be varied as desired by the manufacturer, the retailer or the ultimate consumer. The color of the lamp shade may be varied and various interchangeable decorative trim may be added or removed therefrom as desired. The lamp shade requires no tools or unusual degree of skill for construction and may be disassembled subsequent to assembly for any reason.

Further, individual interchangeable components may be available for custom designed lamp shades, in various compatible combinations, or in knock-down combinations of components in kit form, with or without shade members 12 which may be made by the retailer or the consumer or may be available in various sizes, colors or fabrics. Further, assembly kits may be provided either completely knocked-down, or semi-assembled, for example, with shade member 12 pre-assembled and installed upon the respective upper and lower hoop members 28, thereby requiring only the remaining assembly of support rods, liner and spider, and optional decorative trim.

Obviously, numerous modifications and variations of the present invention are possible in the light of the above teachings. It is therefore to be understood that within the scope of the appended claims the invention may be practiced otherwise than as specifically described herein.

I claim:

1. A collapsible lamp shade comprising:

a shade member formed of a flexible fabric material having upper and lower continuous edge portions defining upper and lower collar portions respectively;

upper and lower rigid hoop members, each hoop member including a circumferentially extending sidewall having a substantially vertical outwardly facing sidewall surface and a shelf portion circumferentially extending outwardly from said outwardly facing surface, said shelf portion on said upper hoop member having a substantially horizontal upwardly facing surface spaced from the upper edge surface thereof and said shelf portion on said lower hoop member having a substantially horizontal downwardly facing surface spaced from the lower edge surface thereof, said upper and lower rigid hoop members further including means provided on their lower and upper edge surfaces respectively for receiving one end of each of a plurality of support rods;

said shade member upper collar portion being removably concentrically located around said upper hoop member outwardly facing sidewall surface and constrained from downward movement by said upwardly facing shelf portion surface and said shade member lower collar portion being removably concentrically located around said lower hoop member outwardly facing sidewall surface and constrained from upward movement by said downwardly facing shelf portion surface; and a plurality of support rods vertically extending between said hoop members inwardly of said shade member, each support rod having a pair of end portions receivable within said end receiving means provided on said hoop members;

whereby said fabric shade member is maintained in a stretched configuration by said rod members which space said hoop members in a mutually opposed, parallel relationship.

2. A collapsible lamp shade as recited in claim 1 further including at least one rigid ring member located over and around at least one of said vertical sidewall surfaces of one of said rigid hoop members against the horizontal surface of said shelf portion associated therewith and having an outer edge extending beyond the outer edge of said shelf portion, said ring member being maintained in position by the stretched fabric shade member whereby said ring member outer edge contour determines the contour of the flexible fabric shade member.

3. A collapsible lamp shade as recited in claim 1 wherein each of said shade member collar portions is defined by a hem formed at the respective shade member edge portion and a strip member formed of a flexible resilient material disposed within the hem having its ends fastened to each other.

4. A collapsible lamp shade as recited in claim 1 further including a decorative band member extending around said collar portion of said shade member.

5. A collapsible lamp shade as recited in claim 1 wherein at least one of said hoop members has a substantially horizontal shoulder on the inboard portion thereof forming an edge surface adapted to contact the support elements of a spider apparatus.

6. A collapsible lamp shade as recited in claim 1 wherein said support rod end portions are substantially U-shaped and said support rod end portion receiving means include a plurality of radially extending slots formed within and around the circumference of one surface of each of said hoop members.

7. A collapsible lamp shade as recited in claim 6 wherein each said hoop member includes a continuous channel formed within and circumferentially around one surface and further including a liner member having upper and lower edges, said liner member upper and lower edges being received within said continuous channels of said upper and lower hoop members respectively and wherein said U-shaped support rod end portions fit within said channels so as not to interfere with said liner edges.

8. A collapsible lamp shade as recited in claim 1 wherein each said hoop member includes a continuous channel formed within and circumferentially around one surface thereof and further including a liner member having upper and lower edges, said liner member upper and lower edges being received within said continuous channels of said upper and lower hoop members respectively.

9. A collapsible lamp shade as recited in claim 8 wherein each said channel is partially defined by an inner sidewall of the respective hoop member, and each inner sidewall has an opening formed therein communicating with said channel for insertion of the edge portions of said liner member into said channels, said openings in said respective hoop members being vertically aligned with each other.

10. A collapsible lamp shade as recited in claim 1 further including indicia provided on each of said hoop members comprising means for facilitating vertical alignment of said support rod end portion receiving means during assembly of said lamp shade.

11. A collapsible lamp shade as recited in claim 1 wherein said support rods comprise straight rods, said end portions being colinear with the body portion thereof.

12. A collapsible lamp shade as recited in claim 11 wherein said support rod end receiving means comprise a continuous channel circumferentially formed within one surface of each hoop member, an elongate, rigid form member located within said channel and a plurality of bushing members received within said channel substantially abutting said elongate, flexible member, each said bushing member having an opening adapted to receive a support rod end portion.

13. A collapsible lamp shade as recited in claim 12 wherein each said hoop member includes a second continuous channel circumferentially formed within one surface inwardly of said support rod end receiving means channel and further including a liner member having upper and lower edges, said liner member upper and lower edges being received within said continuous second channels of said upper and lower hoop members respectively.

14. A collapsible lamp shade as recited in claim 1 further including a collapsible spider assembly for supporting said lamp shade comprising a substantially planar hub member having an upper and a lower surface and having a central opening formed therethrough, means provided on said hub for removably attaching one end portion of each of a plurality of leg members to said hub, a plurality of leg members each having one end portion adapted to be removably attached to said hub member, and means provided on the other end portion of each of said leg members adapted to contact a portion of a lamp shade, whereby said spider assembly supports said lamp shade.

15. A collapsible lamp shade as recited in claim 1 further including decorative strip members having edge portions frictionally engaged between said hoop member vertical sidewall surface and said shade member collar portion.

16. A collapsible spider assembly for supporting a lamp shade comprising:

a substantially planar hub member having an upper and a lower surface and having a central opening formed therethrough, further including at least three sets of channels formed therein, each channel set including a first channel extending from the periphery of said hub and terminating at an enclosed portion and a second channel extending from the periphery of the hub and intersecting said first channel at an angle;

at least three leg members, each leg member having a body portion and one end portion, said one end portion being removably connected to said hub member within a respective channel set, said one end portion comprising a first section angularly extending from said body portion at said angle and a second section angularly extending from said first section at an angle to the plane defined by said body and first section; and means provided on the other end portion of each said leg member for contacting a portion of a lamp shade.

17. A collapsible spider assembly as recited in claim 16 wherein said contacting means include a bushing threadedly affixed to said other end portion of each of said leg members whereby the position of said bushing on said other end portion may be adjusted by rotating said bushing.

* * * * *